United States Patent [19]

Derby et al.

[11] Patent Number: 4,903,859

[45] Date of Patent: Feb. 27, 1990

[54] CONTAINER FOR FLOWABLE MATERIALS

[75] Inventors: Norwin C. Derby, Sherman; Ernest J. Benson, Dallas, both of Tex.

[73] Assignee: Better Agricultural Goals, Inc., Dallas, Tex.

[21] Appl. No.: 248,097

[22] Filed: Sep. 23, 1988

[51] Int. Cl.[4] ..... B65D 25/14

[52] U.S. Cl. ..... 220/462; 217/36; 220/461; 383/119; 493/59; 493/89

[58] Field of Search ..... 206/386, 600; 217/36; 220/403, 404, 416, 441, 461–463; 383/111, 113, 119; 493/59, 89

[56] References Cited

U.S. PATENT DOCUMENTS

| | | | |
|---|---|---|---|
| 1,907,172 | 5/1933 | Arzet | 229/41 R |
| 2,773,636 | 12/1956 | Williams et al. | 383/119 |
| 3,074,617 | 1/1963 | Kindseth et al. | 229/23 R |
| 3,194,471 | 7/1965 | Murphy | 220/416 |
| 3,374,929 | 3/1968 | Sileverskiold . | |
| 3,896,991 | 7/1975 | Kozlowski et al. | 383/119 |
| 4,143,796 | 3/1979 | Williamson et al. . | |
| 4,622,693 | 11/1986 | Mykleby | 383/119 |
| 4,781,475 | 11/1988 | Lafleur | 383/119 |

FOREIGN PATENT DOCUMENTS

| | | | |
|---|---|---|---|
| 1392905 | 2/1965 | France | 220/416 |
| 2141498 | 1/1973 | France . | |
| 0578305 | 6/1958 | Italy | 383/119 |
| 0009560 | of 1905 | United Kingdom . | |
| 0959306 | 5/1964 | United Kingdom | 220/416 |
| 1097040 | 12/1967 | United Kingdom . | |

*Primary Examiner*—Jimmy G. Foster

*Attorney, Agent, or Firm*—Michael A. O'Neil

[57] ABSTRACT

An improved flexible semi-bulk container utilizing rigid panels associated with the side walls of the flexible container to provide rigidity and enable the container to stand alone when filled with fluidized material such as fluidized solids, semi-solids, slurries and liquids.

18 Claims, 2 Drawing Sheets

CONTAINER FOR FLOWABLE MATERIALS

TECHNICAL FIELD

The present invention relates to a flexible semi-bulk material container and, in particular, a flexible container suitable for use with fluidized materials such as fluidized solids, semi-solids, slurries and liquids where the container must have adequate stability to stand alone.

BACKGROUND OF THE INVENTION

Flexible semi-bulk containers are well known in the prior art. They are used to contain flowable materials and when used with fluidized solids, slurries and liquids, a particular problem exists when they are shipped in less than truck load shipments. In such shipments, the packages or containers must have adequate stability to stand alone. Clearly, when a flexible container is filled with a fluidized material such as a liquid, they cannot stand alone unless supported against each other and the walls of some object such as a truck body or bed.

The containers may be constructed from a non-porous material, such as polyethylene, polypropylene, treated paper and the like, so that they can be stored and transported in an exposed condition without contamination of the material therein or without leakage. Because the containers are flexible, they can be collapsed when empty and reused several times if the situation warrants. However when such containers are filled with a fluidized material such as a liquid, they become unstable and tend to react to any motion imparted to them causing them to fall over, distort, change shape and the like.

The present invention overcomes the disadvantages of the prior art in relation to flexible semi-bulk containers which are used with fluidized solids, semi-solids, slurries and liquids by providing the container or package with adequate stability to stand alone when filled with the fluidized material. This is accomplished by the use of panels formed of rigid materials and that are associated with the flexible semi-bulk container. Such panels may be constructed of number of substantially inflexible materials including, but not limited to, hardboard, particle board, corrugated plastic, foamed plastic, solid state fiber (laminated chip board), plyboard and the like. Such panels are associated with the container side walls in such a way that rigidity is imparted to the side walls of the flexible container.

In one embodiment, the flexible container is formed with side walls having a double layer of material with a space between them. A rigid panel is inserted in the space in at least two of the opposing side walls of the container to provide stability to the container. In such case, the at least two opposing panels are scored longitudinally along the center of the panel or is otherwise hinged so that they can fold at the center. This allows the container to be folded, stored and shipped in the smallest possible position during non-use. The panels can be inserted in the spaces between the double layer side walls as the container is made or may be inserted later at the user's location. In the latter case, top or bottom seams can be left unsewn to allow the insertion. If the panels are inserted during the manufacturing of the container, all of the seams can be closed. Panels may be inserted in the space formed by each double layer wall in all four side walls of the container if desired. Again, however, at least two of the opposing side walls must have the score lines to enable the container to be folded during non-use.

Depending upon the type of material used for the rigid panels, the rigid panels may be attached to the inside of the container side walls by laminating the panels to the inside of each wall during manufacturing.

The panels may also be glued to the inside of the side walls as the container is being manufactured. Again, at least two opposing panels must be center scored or otherwise hinged to allow folding of the finished unit.

The invention also contemplates the use of a four-sided sleeve inserted within the flexible container to provide stability to the container when filled with a fluidized material. The sleeve comprises a continuous rectangular panel scored across its width at spaced locations so as to form a four-sided sleeve when folded along the score lines, two opposing sides of the sleeve having score lines thereon to enable folding of the container with the sleeve therein for storage and handling. The four-sided sleeve thus imparts stability to the container when filled with a fluidized material. If desired, the four-sided sleeve may be glued to the inside walls of the container.

The invention also contemplates the use of a composite liquid container that may be used inside any of the containers previously discussed that have rigidity imparted to them by the use of rigid panels as explained. Using any of those containers, a liner of co-extruded plastic film having a fill and a discharge spout for receiving and discharging a liquid, is inserted inside the container. It may or may not be glued in place. With such properly made liner, the containers are useable for a variety of semi-solids and liquids.

The flexible semi-bulk containers can be manufactured of any flexible material with adequate tensile strength including and not limited to reinforced paper, woven polypropylene, woven polyethylene, polyester fabric, burlap fabric, vinyl coated polyester and spun bonded non-woven fabrics. Any fabric of natural or synthetic fiber or a combination thereof can be used.

SUMMARY OF THE INVENTION

The present invention relates to a flexible semi-bulk material container suitable for use with fluidized materials such as fluidized solids, semi-solids, slurries and liquids where the container must have adequate stability to stand alone. The container comprises a flexible body formed with side walls, a top wall and a bottom wall, access spouts in the bottom and top walls as needed to fill and empty said body with fluidized material, and rigid panels associated with at least two of the body side walls for providing rigidity sufficient to impart adequate stability to the flexible body to enable it to stand alone when filled with a fluidized material. At least two of the rigid panels associated with opposing side walls are scored so as to enable an empty container to be folded along the score lines for storing and handling. The rigid panels may be fastened to the side walls of the flexible body such as by gluing or laminating them to the side walls.

The invention also relates to a method for stabilizing a flexible semi-bulk material container when filled with a fluidized material such as fluidized solids, semi-solids, slurry and liquids so as enable the filled container to stand alone comprising the steps of forming a flexible body portion with side walls, a top wall and a bottom wall, forming access spouts in the bottom and top walls as needed to fill and empty the body portion with fluidized material, and associating rigid panels with at least two of the side walls for providing rigidity sufficient to impart adequate stability to the flexible body portion to enable it to stand alone when filled with a fluidized material.

BRIEF DESCRIPTION OF THE DRAWINGS

The invention will be more fully disclosed in conjunction with the accompanying drawings in which.

DETAILED DESCRIPTION OF THE DRAWINGS

Figure 1:
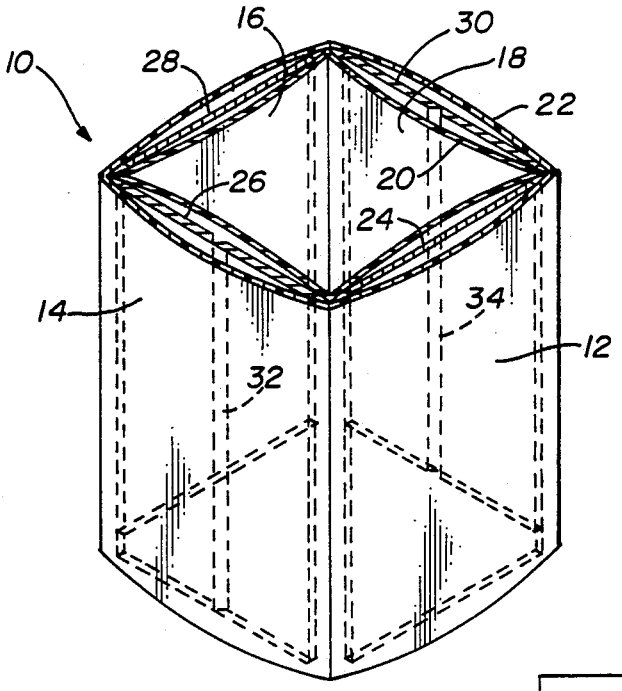
FIG. 1 is a perspective view of a flexible semi-bulk container having double layer side walls with a space between the layers and a rigid panel inserted in the space in each side wall to impart rigidity to the flexible container.

FIG. 1 is a perspective view of the novel flexible semi-bulk container of the present invention that is suitable for use with fluidized solids, semi-solids, slurries, liquids and for shipping in less than truckload shipments where the package must have adequate stability to stand alone. In the embodiment shown in FIG. 1, the container 10 has four side walls 12, 14, 16 and 18, each of which has an inner and an outer wall 20 and 22, respectively, which may be formed of, but not limited to, reinforced paper, woven polypropylene, woven polyethylene, polyester fabric, burlap fabric, vinyl coated polyester, spun bonded non-woven fabrics or any fabric of natural or synthetic fiber or a combination thereof. Because those materials are flexible, however, the container would not have rigidity if filled with a fluidized material. Therefore, as shown in FIG. 1, a rigid panel 24, 26, 28 and 30, is inserted in the space formed by inner and outer layers 20 and 22 of each of the side walls 12, 14, 16 and 18. The rigid panels may be formed of different materials including, but not limited to, hard board, particle board, corrugated plastic, foamed plastic, solid state fiber (laminated chip board) and plywood. The top of the container 10 shown in FIG. 1 is illustrated in cross-section s that the construction of the container can be shown in detail. However, the container would normally have a top panel thereon which has a filling spout as is well known in the art. In like manner, a bottom panel is formed which may have a discharge spout if desired. Again, such construction is well known in the art and is not shown for purposes of simplicity of the drawings. The embodiment of FIG. 9 does illustrate such spout.

However, it will be noted in FIG. 1 that panels 26 and 30, which oppose each other, each have a respective score line 32 and 34 which enable the container 10 to be collapsed for purposes of storage and handling when emptied by folding panels 26 and 30 inwardly about the score lines 32 and 34. The container 10 when partially folded would have the general configuration shown in FIG. 7 when viewed from the top or bottom.

Figure 2:
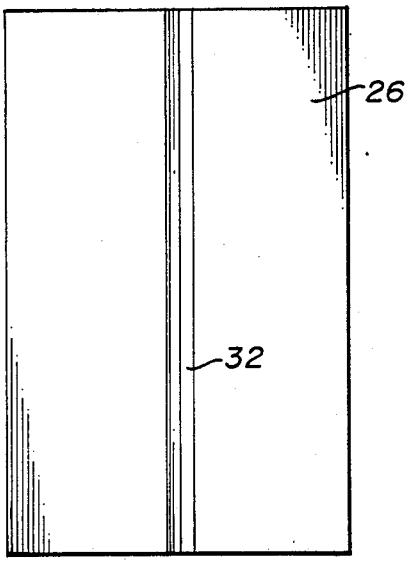
FIG. 2 is a side view of one of the rigid panels illustrating the score line which enables the rigid panel to be folded.
Figure 4:
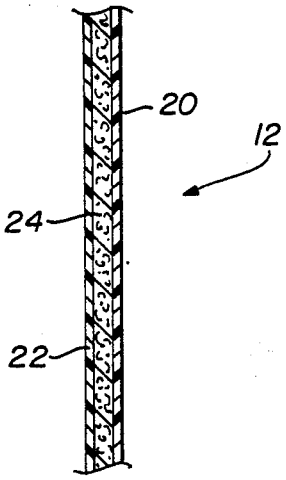
FIG. 4 is a partial cross-sectional view of one of the side walls of the container of FIG. 1 illustrating the double side walls with the rigid panel inserted in the space between them.
Figure 3:
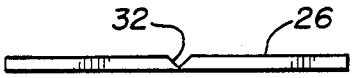
FIG. 3 is an end view of the rigid panel in FIG. 2.

The panels 24, 26, 28 and 30, as shown in FIG. 1, are sandwiched between double side walls 20 and 22. These panels 24, 26, 28 and 30 can be inserted at the sack is made or inserted later at the user's location. In the latter case, top or bottom seams may be left open to allow the insertion. If the panels are inserted during manufacturing, all of the seams can be closed. If the panels are inserted at the user's location, it would not be necessary to have score lines 32 and 34 since rigidity is not imparted to the container 10 until the panel boards are inserted. FIG. 2 is a side view of one of the panels 26 shown in FIG. 1 illustrating score line 32 which enables panel 26 to be folded inwardly in FIG. 1. FIG. 3 is a bottom view of the panel 26 illustrated in FIG. 2. FIG. 4 is a partial cross-sectional view of one of the side walls 12 illustrating the double wall construction with inner wall 20, outer wall 22 and rigid panel 24 inserted between the double walls.

Figure 5:
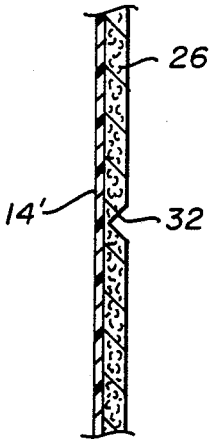
FIG. 5 is a partial cross-sectional view of a side wall of an alternate embodiment having a single layer side wall on the flexible container and the rigid panel associated with the side wall and that is laminated or glued or otherwise associated with the side wall to impart rigidity to it.

FIG. 5 is a partial cross-sectional view of an alternate embodiment of the present invention wherein a panel 26 such as that illustrated in FIG. 1 may be attached to a side wall 14' of a container where the container has single ply side walls instead of double ply side walls and the panel 26 may be glued, laminated to or otherwise attached to the material forming the single wall 14' in any well known fashion. Again, the panel 26 may have a score line 32 if it is one of the panels which needs to be folded inwardly to enable the unused or emptied container to be folded for storing and transportation.

Figure 6:
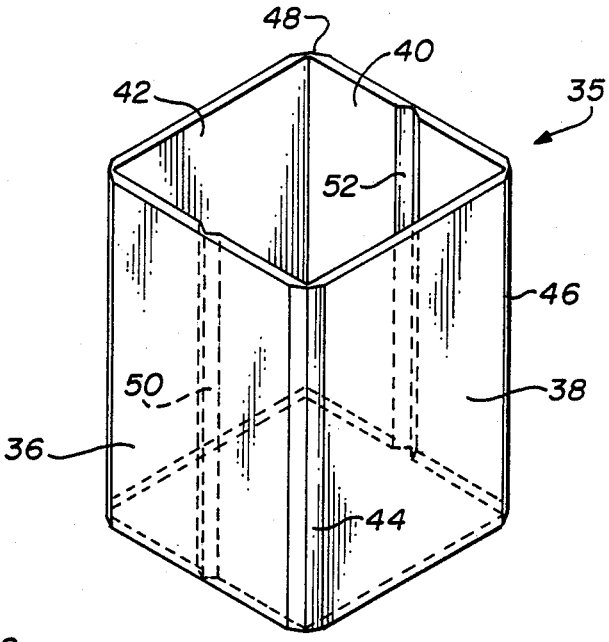
FIG. 6 is a perspective view of a sleeve of rigid material that has two opposing sides scored for flat folding and which may be inserted into the interior of a flexible container for imparting rigidity thereto.
Figure 8:
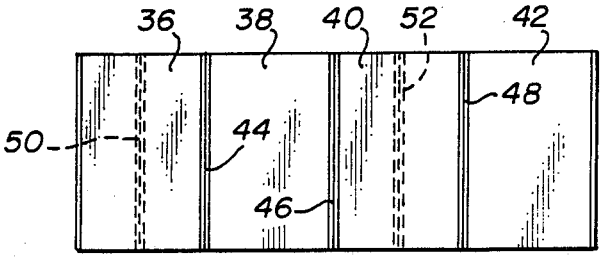
FIG. 8 is a plan view of the sleeve of FIG. 6 prior to its being folded and illustrating the score lines separating the panels and the score lines o opposing panels which enable the sleeve to be folded with the container in which it is inserted.

FIG. 6 is a perspective view of a sleeve 35 of rigid material which may be inserted into a flexible container to provide rigidity to it. The sleeve 35 comprises walls 36, 38, 40 and 42 which are constructed in a single unit as illustrated in FIG. 8. Score lines 44, 46 and 48 allow the panel shown in FIG. 8 to be folded to form the square sleeve shown in FIG. 6. The sleeve 35 could be formed in any rectangular shape instead of a square. Panels 36 and 40 each have a perspective score line 50 and 52 which will enable the container in which the sleeve 35 is inserted to be folded when empty. If it is permanently inserted inside the container, it may be glued to the inside walls of the container. If it is to be inserted only at the time of use of the container, then score lines 50 and 52 would not be necessary since the container would only be used in the full condition and would not need to be folded.

Figure 7:
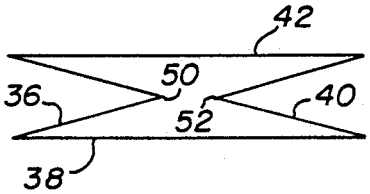
FIG. 7 is an illustrative top view of the sleeve shown in FIG. 6 in its partially folded condition.

FIG. 7 is a diagrammatic illustration of the sleeve of FIG. 6 in its folded condition thereby illustrating how the score lines 50 and 52 enable the unit to fold when not in use.

Figure 9:
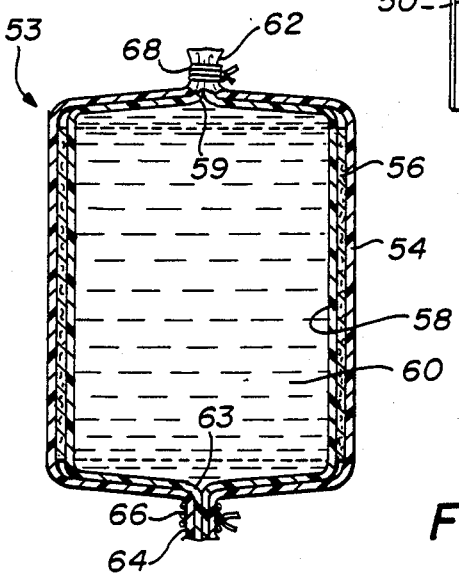
FIG. 9 is a cross-sectional view of a rigidly supported flexible container such as that illustrated in FIG. 1 in which a liner of co-extruded plastic film having a fill spout and a discharge spout is inserted to enable the container to be used for a variety of semi-solids and liquids.

Another embodiment of the present invention is a composite liquid container as shown in FIG. 9. Using any of the constructions as illustrated in FIGS. 1, 5 or 6, a liner of co-extruded plastic film having a fill spout and a discharge spout may be inserted in any of those containers for use with a variety of semi-solids and liquids. As shown in FIG. 9, a container 53 includes a single wall flexible body portion 54 which may be of any of the materials disclosed earlier having a rigid panel 56 associated therewith on the inside in any well known manner including gluing or laminating. A co-extruded plastic film 58 forms a liner which is inserted inside the container 53. It has a fill spout 59 associated with the fill spout 62 of the outer body portion 54. It also may have a discharge spout 63 associated with the discharge spout 64 of the outer body portion 54. These spouts may be secured by any well known means such as ties 66 and 68. With the liner spout 59 open and the top body portion spout 62 open, and the bottom spout closed the container may be filled with liquid. The top spouts 59 and 62 are then closed by ties 68. The container 53 will then have rigidity because of the rigid panels 56 and the container will stand alone while carrying the liquid 60 therein. Such container is useable for a variety semi-solids and liquids.

Thus, there has been disclosed a new and improved flexible semi-bulk container which has rigidity given to it to make it more suitable for use with fluidized solids, semi-solids, slurries and liquids by enabling the package to have adequate stability to stand alone and thus enabling the container to be shipped in less than truckload quantities. This rigidity is imparted to the flexible containers through the use of panels of rigid materials which can be attached to the containers by sandwiching it between double side walls, by laminating it to the inside of the container walls or by gluing it to the inside of the container walls. In addition, score lines are formed on the rigid panels that are to be permanently attached to a flexible container to enable the rigid walls to be folded and the container collapsed for shipment or storage when not in use. Another embodiment of the concept is to use a sleeve of material that has two sides scored or hinged for flat folding. This four-sided sleeve is inserted into the container and may or may not be glued to the inside walls. Finally, another embodiment of the invention utilizes a liner of co-extruded plastic film with a fill spout and a discharge spout and which is inserted inside a container having rigid wall panels to give stability to the container. Such liner may or may not be glued in place. With a properly made liner, the container is useable for a variety of semi-solids and liquids.

Although the invention has been described and illustrated in detail, it is to be understood that the same is by way of illustration and example only and is not to be taken by way of limitation. The spirit and scope of this invention are to be limited only by the terms of the appended claims.

We claim:

1. An improved flexible semi-bulk material container suitable for use with fluidized materials such as fluidized solids, semi-solids, slurry and liquids and having adequate stability to stand alone, said container comprising:

a flexible body portion formed with side walls, a top wall and a bottom wall;

each of said side walls being double-layer side walls sealed at the side edges thereof to provide a space therebetween;

access spouts in the body portion to fill and empty the body portion with fluidized materials; and rigid panels associated with at least two opposing ones of the body side walls, a separate one of said rigid panels inserted in said space in at least two of said opposing double-layer side walls to provide rigidity sufficient to impart adequate stability to the flexible body portion to enable it to stand alone on said bottom wall when filled with a fluidized material.

2. A container as in claim 1 wherein said at least two rigid panels associated with opposing side walls are scored lengthwise to enable an empty container to be folded along the score lines for storing and handling of the container.

3. A container as in claim 2 further including means for fastening said rigid panels to said at least two side walls.

4. A container as in claim 3 wherein said fastening means is glue.

5. A container as in claim 1 wherein each of said double-layer side walls has a rigid panel inserted in each side wall space between the double layers.

6. A container as in claim 5 wherein each double-layer side wall is sealed on the edges to contain said rigid panel therein.

7. An improved flexible semi-bulk material container suitable for use with fluidized materials such as fluidized solids, semi-solids, slurry and liquids and having adequate stability to stand alone comprising:

a flexible body portion formed with side walls, a top wall and a bottom wall;

access spouts in the body portion to fill and empty the body portion with fluidized materials;

a rigid four-sided sleeve inserted within said flexible body portion to provide rigidity sufficient to impart adequate stability to the flexible body portion to enable it to stand alone on said bottom wall when filled with a fluidized material;

said sleeve comprising a continuous rectangular rigid panel scored across its width at spaced locations to form a four-sided sleeve when folded along said score lines, two opposing sides of said sleeve having score lines on the inside surface thereof to enable folding of said container with the sleeve therein for storage and handling; and said four-sided sleeve imparting said rigidity and stability to said container when filled with a fluidized material.

8. A container as in claim 7 wherein said four-sided sleeve is glued to the inside of said container.

9. A container as in claim 7 further comprising:

a liner of co-extruded plastic film;

a closeable fill and discharge spout in said liner for receiving and discharging a liquid; and means for removably attaching said liner to the inside of said container for holding said liquid in said stabilized container which stands alone when filled with said liquid because of said rigidity and stability.

10. A method for stabilizing a flexible semi-bulk material container when filled with a fluidized material such as fluidized solids, semi-solids, slurry and liquids so as to enable the filled container to stand alone, said method comprising the steps of:

forming a flexible body portion with side walls, a top wall and a bottom wall;

each of said side walls being double-layer side walls sealed at the side edges thereof to provide a space therebetween;

forming access spouts in the body portion to fill and empty the body portion with fluidized materials; and inserting a separate one of said rigid panels in said space in at least two of said opposing double-layer side walls to provide rigidity sufficient to impart adequate stability to the flexible body portion to enable it to stand alone on said bottom wall when filled with a fluidized material.

11. A method as in claim 10 further comprising the step of scoring lengthwise said at least two rigid panels associated with opposing side walls to enable an empty container to be folded along the score lines for storage and handling of the container.

12. A method as in claim 11 further including the step of fastening said rigid panels to said at least two side walls.

13. A method as in claim 12 further comprising the step of using glue as said fastening means.

14. A container as in claim 10 further comprising the step of inserting a rigid panel in each side wall space in each of the double-layer side walls between the double layers.

15. A method as in claim 14 further comprising the step of sealing each double-layer side wall on all edges to contain the rigid panel therein.

16. A method for stabilizing a flexible semi-bulk material container when filled with a fluidized material such as fluidized solids, semi-solids, slurry and liquids so as to enable the filled container to stand alone, said method comprising the steps of:

forming a flexible body portion with side walls, a top wall and a bottom wall;

forming access spouts in the body portion to fill and empty said body portion with fluidized materials;

forming a sleeve from a continuous rectangular panel scored across its width at spaced locations to form a four-sided sleeve when folded along said score lines;

inserting said four-sided sleeve within said flexible container to provide said stability to the container when filled with a fluidized material; and forming additional score lines in at least two opposing sides of said sleeve on the inside surface thereof to enable folding of said container with the sleeve therein for storage and handling, said four-sided sleeve imparting rigidity and stability to said container when filled with a fluidized material.

17. A method as in claim 16 further including the step of gluing said four-sided sleeve to the inside walls of said container.

18. A method as in claims 16 further comprising the steps of:

forming a liner of co-extruded plastic film;

placing a closeable fill and discharge spout in said liner for receiving and discharging a liquid; and removably attaching said liner to the inside of said container for holding said liquid in said stabilized container which stands alone when filled with said material because of said rigidity and stability.

* * * * *

US004903859B1

REEXAMINATION CERTIFICATE (4039th)

United States Patent [19] [11] B1 4,903,859

Derby et al. [45] Certificate Issued Apr. 18, 2000

[54] CONTAINER FOR FLOWABLE MATERIALS

[75] Inventors: Norwin C. Derby, Sherman; Ernest J. Benson, Dallas, both of Tex.

[73] Assignee: Better Agricultural Goals, Inc., Dallas, Tex.

Reexamination Request:
No. 90/004,667, Jun. 12, 1997

Reexamination Certificate for:

| | |
|---|---|
| Patent No.: | **4,903,859** |
| Issued: | **Feb. 27, 1990** |
| Appl. No.: | **07/248,097** |
| Filed: | **Sep. 23, 1988** |

[51] Int. Cl.[7] ..... B65D 25/14

[52] U.S. Cl. ..... 383/41; 217/36; 383/104; 383/109; 383/119; 493/59; 493/89

[58] Field of Search ..... 141/390; 383/119, 383/67

[56] References Cited

PUBLICATIONS

Stipulated Prior Art "Safe Handling Instructions and Glossary of Terms for Flexible Bulk Containers", FIBCA (Flexible Intermediate Bulk Container Association), 4 pages.

Waste Wrangler II/The Pioneer product brochure, which is admitted prior art by the patent owner, 1985.

*Primary Examiner*—Stephen P. Garbe

[57] ABSTRACT

An improved flexible semi-bulk container utilizing rigid panels associated with the side walls of the flexible container to provide rigidity and enable the container to stand alone when filled with fluidized material such as fluidized solids, semi-solids, slurries and liquids.

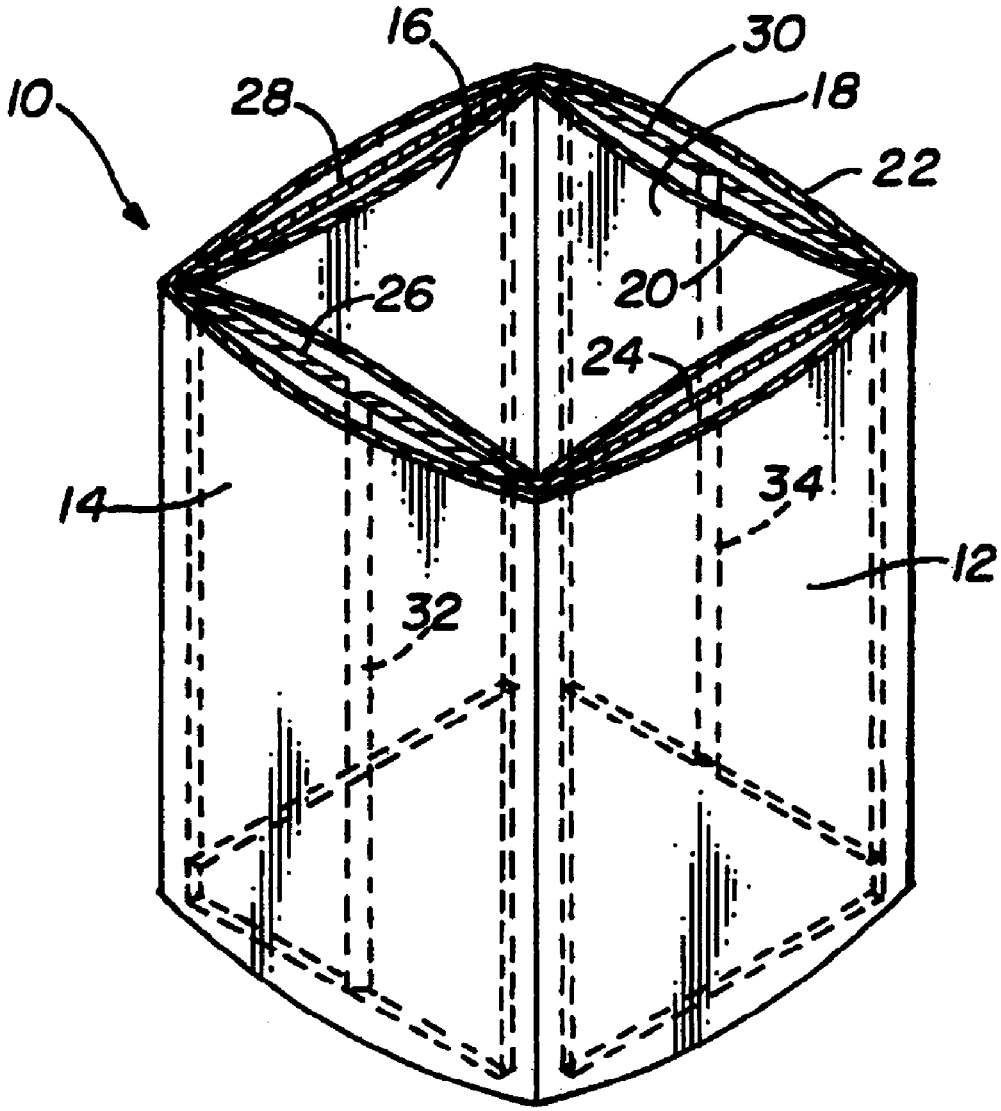

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 7–18 is confirmed.

Claims 1–6 are cancelled.

* * * * *